United States Patent [19]

Sprehn

[11] Patent Number: 4,776,728

[45] Date of Patent: Oct. 11, 1988

[54] ANGULATED RETAINING WALL

[76] Inventor: Eugene A. Sprehn, 13600 N. Gate Dr., Silver Spring, Md. 20906

[21] Appl. No.: 24,532

[22] Filed: Mar. 11, 1987

[51] Int. Cl.[4] ..... F02D 17/00

[52] U.S. Cl. ..... 405/285; 52/233; 256/19; 405/275; 405/284

[58] Field of Search ..... 405/284, 285, 274, 275, 405/276, 278; 256/24, 25, 19; 52/233, 249

[56] References Cited

U.S. PATENT DOCUMENTS

| | | | |
|---|---|---|---|
| 400,155 | 3/1889 | Williscraft | 405/274 |
| 850,496 | 4/1907 | Schuchart et al. | 405/274 |
| 1,001,963 | 8/1911 | Latham | 405/275 |
| 1,052,251 | 2/1913 | Hoag | 405/274 |
| 1,318,097 | 10/1919 | Mesiroff | 405/285 X |
| 1,442,279 | 1/1923 | Lloyd | 405/275 |
| 1,939,528 | 12/1933 | Swift | 52/595 |
| 2,669,060 | 2/1954 | Kalvig | 52/233 X |
| 3,732,653 | 5/1973 | Pickett | 256/19 |
| 4,312,161 | 1/1982 | Goldade | 52/233 |

FOREIGN PATENT DOCUMENTS

| | | | |
|---|---|---|---|
| 3322110 | 12/1984 | Fed. Rep. of Germany | 405/275 |

OTHER PUBLICATIONS

Interlocking Concrete Sheet-Pile Bulkhead Engineering Record, Aug. 30, 1913.

*Primary Examiner*—Dennis L. Taylor
*Attorney, Agent, or Firm*—Benjamin J. Goldfarb

[57] ABSTRACT

An angulated retaining wall comprised of a plurality of adjoining posts is disclosed for retaining a wall of material having gradual and/or abrupt changes in direction in its face. The retaining wall is comprised of corner-groove combinations wherein a corner of a post is disposed at a desired direction into a groove of an adjoining post and wherein the preferred angularity of said groove is less than that of the predetermined angularity of said corner. At the maximum disposition a first side of a corner will be parallel to and overlap in supportive contact with a first sidewall of said groove by a predetermined dimension between said corner and the edge of the first sidewall, and the adjacent side of said corner will be in supportive contact with the edge of the second sidewall of said groove. At an intermediate disposition the first side and the adjacent second side of said corner will be in supportive contact with the edges of the first sidewall and the second sidewall respectively of said groove. Starter posts, line posts, key posts, corner posts, and end posts are disclosed.

14 Claims, 6 Drawing Sheets

ANGULATED RETAINING WALL

BACKGROUND OF THE INVENTION

1. Field of the Invention

The present invention relates to a retaining wall and, more particularly, to an angulated retaining wall comprised of posts wherein each post is at a predetermined direction to the respective adjoining post and tightly engaged therewith.

2. Description of Prior Art

Although retaining walls have been used for walls of material such as, for example, dirt, clay and sand, they have commonly been employed in applications where the walls of material have a uniformly flat face configuration. The retaining wall, consequently, is commonly constructed along a substantially straight line configuration to be in contact with the face of the wall of material being retained. Such retaining walls are usually constructed of stone, concrete, steel, timbers, or combinations thereof. U.S. Pat. No. 1,052,251, issued Feb. 4, 1913, G. B. Hoag, is an example of a uniform straight wall of sheet pilings forming a tight sheet impervious to water and quicksand constructed of wood planks, each having a facing strip B of channel steel secured on one of two opposite side of a plank and having flanges facing outwardly. Another facing strip C is of segmental cross section secured on the opposite side of the plank with its curved side facing outwardly. The planks are assembled with the strip C laid into the channel of strip B, making a three-point contact against the two flanges and the web of the channel.

Construction of walls providing for abrupt changes in direction and turning corners is disclosed in U.S. Pat. No. 850,496, issued Apr. 16, 1907, P. S. Schuchart and G. G. Brown. This patent provides for composite sheet pilings for watertight sea walls, docks, and pier-foundations. The pilings are comprised of interlocked alternating wood planks and metal beams having a relatively complex jaw structure. Each beam has a central longitudinal web from one edge of which two opposite long jaws extend and from the other edge of which two opposite short jaws extend. The opposite jaws of each beam are imbedded in the opposite faces of the adjacent planks.

U.S. Pat. No. 1,939,528 issued Dec. 12, 1933, C. K. Swift, provides for a wall board joint comprising a male and female member, each having longitudinal beveled edges, the angle of bevel of the male member being greater than that of the angle of bevel of the female member, whereby a tight joint is provided. The respective units are maintained in co-planar alignment with respect to each other.

A form of angulated wall has been utilized for retaining a wall of material having a curved configuration which has adjoining square posts set vertically into the ground with the flat side of one post making contact with the flat side of the next post when in a straight line configuration. When the wall curves, an edge of one side will contact the edge of the adjoining side and, as the curvature increases, although one side will appear to be continuous, gaps or openings on the other side of the wall will enlarge as the change in direction from one post to the other increases. A contact between two adjoining posts is provided only along the one line of contact at the edges of the respective sides. A similar wall with adjoining cylindrical posts positioned vertically also provides only one line of contact between adjoining posts. This may prove to be inadequate support for retaining a wall of material wherein ground pressures build up over a period of time and can cause shifting of the individual posts. The disadvantage of said wall is that the posts must be set deeply into the ground and reinforced with straps, cables, and/or long pins to provide additional and adequate support.

The angulated retaining wall of the subject invention is comprised of corner-groove combinations to provide for changes in direction by disposing a corner of a post into the groove of an adjoining post. Said disposing of the corner may be from a maximum clockwise or counter clockwise rotation within said groove to any intermediate rotation therebetween. The preferred angularity of the groove is less than the angularity of the disposed corner. Maximum rotation of a disposed corner within a respective groove is required for applications such as, for example, where abrupt changes in direction are required as at corners. Intermediate rotations of a disposed corner to a desired direction within a respective groove may be necessary for other applications such as, for example, where there are relatively minor departures from a straight line configuration as well as a straight line configuration.

For maximum rotations, supportive contact is provided between a side of a disposed corner and a respective overlapping sidewall of the groove as well as between an adjacent wall of said corner and an edge of the other sidewall of said groove. For intermediate rotations in direction, supportive contact will be between two adjacent sides of the disposed corner and the edges of the two respective sidewalls of the groove. The supportive contacts are augmented by pinning to tightly engage only two adjoining posts. The posts are normally set to about $\frac{1}{3}$ their length.

The angulated retaining wall of the subject invention provides a number of advantages such as, for example:

a. Strength. The posts are installed vertically with the diagonal dimension perpendicular to the pressure forces acting against said wall. Consequently, the widest portion of the post is used to counteract said forces which are applied along the entire length from top to bottom.

b. Versatility. To change the direction of the wall as it is being installed, it is required only that the angular rotation of the post members change in accordance with the desired change in direction of the wall. This is done by merely disposing a corner of a post into the respective groove of an adjoining post at the desired direction prior to pinning. Different heights for the wall of the subject invention can be achieved by using longer or shorter posts where appropriate. The tops of said posts can be cut after installation such as, for example, at a 45° angle to create a sawtooth shaped edge, or other appearance as may be desired. The visual appearance of said wall is the same on both sides so that opposite directional changes may be made without changing materials.

c. Simplicity. Materials used for the subject invention are readily available in most lumber yards and material supply centers. Only one edge of a line post has to be modified to create a post that has both a full-length groove (female) and a corner (male) where a corner of a line post is disposed into the groove of an adjoining line post in supportive contact. They are then interlocked and tightly engaged by appropriate pinning at a desired direction with respect to each other. Starter posts and end posts each have a side groove; corner posts have a groove in two adjacent sides. Key posts have no grooves. Various combinations of starter posts, line posts, key posts, corner posts and end posts may be employed to form a continuous angulated retaining wall. Pressure-treated, treated, rot-resistant wood is preferred due to its relatively long life.

The said corner-groove combination allows a corner to be in supportive contact with a respective adjoining groove at a desired direction as needed to form a retaining wall to follow changes in configuration of the face of the wall of material being retained. The pins provide tight engagement between adjoining posts and prevent rotation therebetween. The stability of the angulated retaining wall is somewhat analogous to the stability of a cardboard having a number of angularities or folds and, when resting on its edge, will resist falling over when subjected to side forces.

Posts are installed vertically and, in the event that a post is slightly warped, the groove can be altered slightly to achieve verticality with the disposing corner of the adjoining post. Exposure to moisture may cause the wooden posts to swell sufficiently to seal the corner-groove joints against water seepage. Drainage holes may be easily provided if required to prevent buildup of pressure due to water.

It is an object to provide an angulated retaining wall comprised of relative low cost parts readily available at lumber yards and/or other material supply houses.

It is another object to provide a corner-groove interlocking joint wherein the preferred angularity of the groove is less than that of the corner of the adjoining post and wherein there is supportive contact between a side of the corner with an overlapping sidewall of a groove and between the adjacent side of said corner and an edge of the other sidewall of the groove when the corner is positioned at a maximum rotation with respect to said groove.

It is still another object to provide said corner-groove interlocking joint where there is supportive contact between two adjacent sides of a corner with the two edges of a respective groove when the corner has been positioned at an intermediate rotation with respect to said groove.

A further object is to provide an angulated retaining wall with means to tightly engage said corners and respective grooves for general use and whereever changes indirection must be provided for such as, for example, landscaping and constructions at building sites, highways, and water fronts.

A still further object is to provide an angulated retaining wall comprised of readily adaptable posts wherein it is relatively easy to construct various corner-groove combinations to provide for maximum and intermediate changes in direction for said wall wherein a full-length groove is cut into a single corner of line posts, into one side of starter and end posts, into two adjacent sides of corner posts, and no grooves cut into key posts, and wherein the preferred angularity of the groove is less than that of the respective corner, and wherein combinations of said posts can be readily adapted to form an angulated retaining wall for minor as well as abrupt changes in the configuration of the face of the material being retained and, furthermore, utilized as a straight wall if desired.

BRIEF DESCRIPTION OF THE DRAWINGS

FIG. 5B is a plan view of a corner of a line post disposed into the respective groove of a starter post similar to that of FIG. 5 except that said corner is shown positioned at an intermediate rotation with respect to said groove.

SUMMARY OF THE INVENTION

In accordance with the present invention of an angulated retaining wall, there is disclosed a plurality of adjoining posts including starter posts, line posts, key posts, corner posts, and end posts, wherein various combinations of said posts may be utilized to form said wall. The starter and end posts each have a side groove, the corner posts each have a side groove in two adjacent sides, the line posts each have one corner groove, and the key posts have no grooves. The preferred angularity of each full-length groove is less than that of a disposing corner of an adjoining post. Each said groove has a first sidewall and a second sidewall intersecting in a vertex parallel to the longitudinal axis of the respective post; the sidewalls are of equal width and extend from said vertex to a first and second edge respectively. Each said corner has a first side and an adjacent second side, said sides intersecting in said corner. The posts are interlocked by disposing a corner of a post into a groove of an adjoining post and tightly engaged therein by pinning. The corner and said first edge and the first and second edges are separated by predetermined dimensions respectively. When the corner is positioned within a groove at maximum rotation, the first side is parallel to the first sidewall and overlaps in supportive contact with said first sidewall between said corner and first edge and the adjacent second side is in supportive contact with said second edge. When the corner is positioned within a groove at an intermediate rotation, supportive contact will be between two adjacent sides of the disposed corner and the edges of the two respective sidewalls of the groove.

DESCRIPTION OF THE PREFERRED EMBODIMENT

Figure 1:
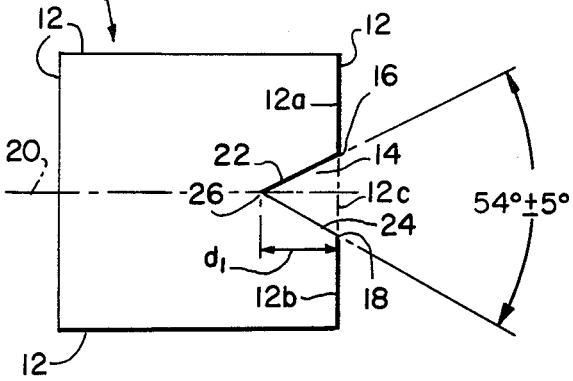
FIG. 1 is a plan view of the starter post with a side groove.
Figure 2:
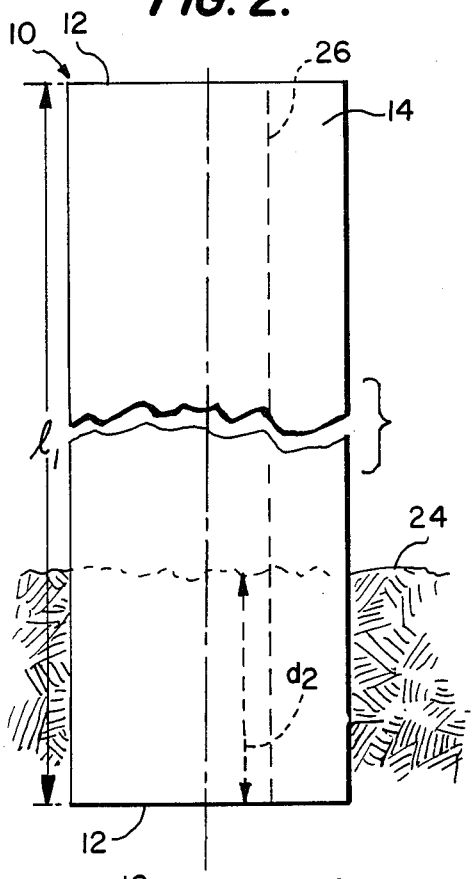
FIG. 2 is a fragmented side view of the starter post partly disposed into the ground.

Referring to FIG. 1, starter post 10 of an angulated retaining wall has a square cross section wherein each side 12 is of a predetermined equal dimension and predetermined overall length $l_1$ as shown in FIG. 2. A full-length equal-sided groove 14 of predetermined angularity of less than 90° is cut into a side 12 at edges 16 and 18, each at a predetermined equal dimension from centerline 20 to form a first sidewall 22 and a second sidewall 24 respectively and intersecting to form vertex 26 at a depth $d_1$, said sidewall edge 16 being at a predetermined dimension from sidewall edge 18. Said side 12 is thus divided into three sections, namely upper section 12*a*, lower section 12*b*, and center section 12*c*. The volume of material bounded by sidewalls 22 and 24 and center section 12*c* and by length $l_1$ are removed from said post to form said groove 14. Starter post is positioned vertically to a depth $d_2$ into the ground 24.

Figure 3:
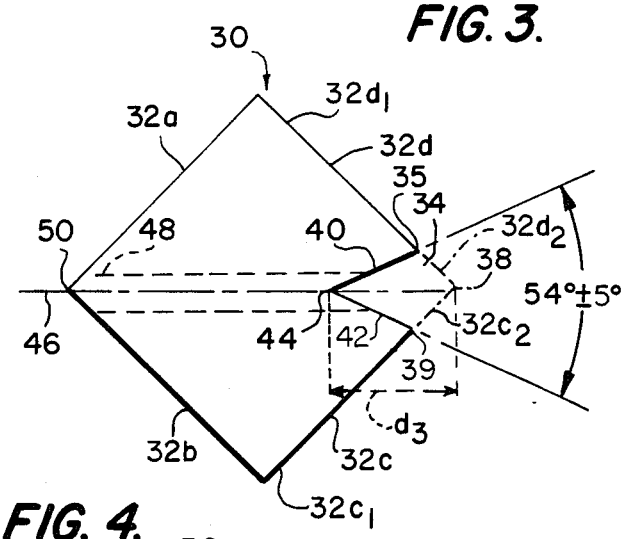
FIG. 3 is a plan view of a line post with a corner groove and the predrilled holes in relation to said groove.
Figure 4:
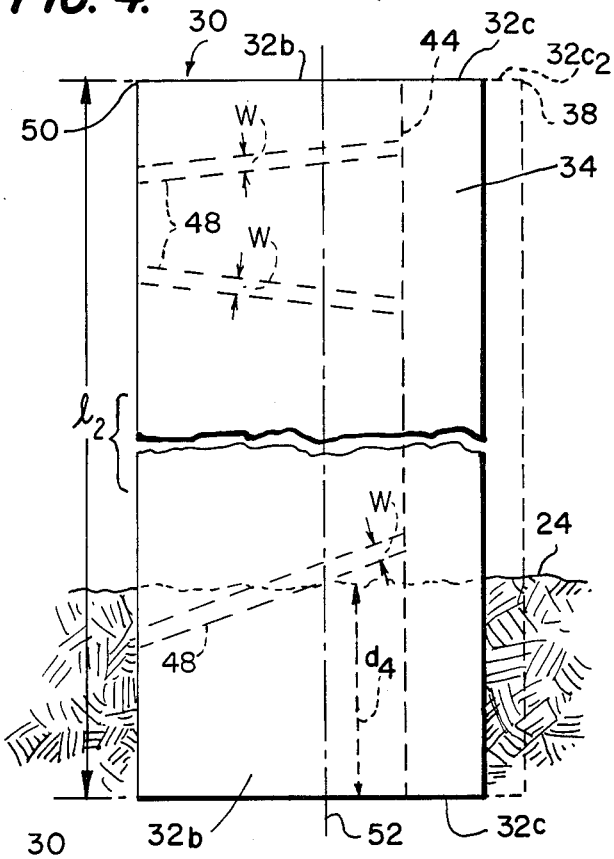
FIG. 4 is a fragmentary side view of a line post partly disposed into the ground and the predrilled holes.

Referring to FIG. 3, line post 30 has a square cross section wherein each side 32*a*, 32*b*, 32*c*, and 32*d* is of a predetermined equal dimension and an overall length $l_2$ as shown in FIG. 4. In FIG. 3 a full-length equal-sided groove 34 of predetermined angularity of less than 90° is cut into side 32*d* at sidewall edge 35 and into side 32*c* at sidewall edge 39 respectively each at a predetermined equal dimension from corner 38 to form a first sidewall 40 and a second sidewall 42 respectively intersecting to form vertex 44 at a depth $d_3$, said groove 34 being bisected by centerline 46. Sidewall edge 35 is at a predetermined dimension from sidewall edge 39. Side 32*d* is thus divided into an upper section $32d_1$ and a lower section $32d_2$ and side 32*c* is divided into a lower section $32c_1$ and an upper section $32c_2$. The volume of material bounded by sidewall 40 and 42 and by lower section $32d_2$ and by upper section $32c_2$ and by length $d_2$ is removed from said post to form groove 34. Line post 30 is positioned vertically to a depth $d_4$ into the ground 24. In FIG. 4 are shown a predetermined number of predrilled holes 48 of a diameter w disposed through post 30 from vertex 44 to corner 50; said corner 50 is opposite to corner 38. Said predrilled holes are toenailed, that is, the holes are slightly askew with respect to each other along the longitudinal axis 52 for greater retention ability.

Figure 5:
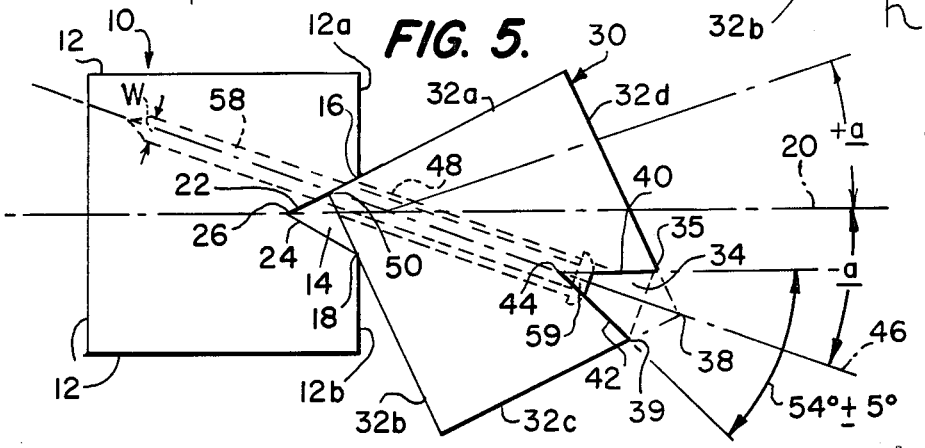
FIG. 5 is a plan view of a corner of a line post disposed into the respective groove of a starter post and tightly engaged therein by pins inserted into the predrilled holes in the line post and driven into the adjoining starter post and wherein the groove in each post is at the preferred angularity. Said corner is shown positioned at maximum clockwise rotation with respect to the groove.

FIG. 5 shows an example of two tightly engaged interlocking posts where line post 30 is positioned to engage its corner 50 into side groove 14 of starter post 10 and at a maximum clockwise rotation −a between respective centerlines 20 and 46. Corner 50 will not contact vertex 26 of post 10 since the angularity of corner 50 is greater than the angularity of groove 14. As post 30 is rotated in a clockwise direction with respect to post 10, the location of corner 50 with respect to sidewalls 22 and 24 of groove 14 will also change. Groove 14 has a preferred angularity to limit the penetration of corner 50 so that when side 32*a* of corner 50 is parallel to sidewall 22 of groove 14, the side 32*a* will overlap by a predetermined dimension in supportive contact with sidewall 22 between corner 50 and sidewall edge 16. Adjacent side 32*b* of said corner 50 will also be in supportive contact with sidewall edge 18 of groove 14. Similarly, when post 30 is in a maximum counter clockwise rotation (not shown) at an angle +a to post 10, then side 32*b* will be parallel to and overlap by a predetermined dimension in supportive contact with sidewall 24 and adjacent side 32*a* will then be in supportive contact with sidewall edge 16.

For optimum supportive contact between interlocking posts and stability of the angulated retaining wall, the preferred angularity of all grooves should be 54°±5°. The maximum clockwise or counter clockwise rotation of a corner of a post disposed in a groove will be about 18°±3°. Experience indicates that the predetermined dimension for overlap should be about $\frac{5}{8}''$ for 4″×4″ posts. Also, for 4″×4″ posts the dimension from corner 38 to first sidewall edge 35 and to the second sidewall edge 39 should be about $\frac{7}{8}''$ and the dimension from the first sidewall edge 35 to the second sidewall edge 39 should be about $1\frac{1}{8}''$. With respect to the side groove of the starter post 10, the dimension from the first sidewall edge 16 to the second sidewall edge 18 should also be about $1\frac{1}{8}''$. Corner grooves have a depth of about $1\frac{1}{4}''$ and the side grooves have a depth of $\frac{3}{4}''$ to 1″. Dimensions are approximate since lumber sizes vary from advertised dimensions.

Figure 5A:
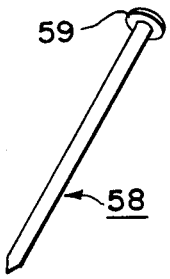
FIG. 5A shows an example of a pin such as a nail.

Also shown in FIG. 5 are the locations of the predrilled holes 48 of diameter w in the "joining" or successive post 30 and the approximate penetration that pins 58, see FIG. 5A, can have in the adjoining "fixed" or preceeding post 10 to tightly engage and to interlock the joining and fixed posts. After post 30 is tightly engaged with post 10, then post 30 is referred to as a "fixed" post with respect to the "joining" post then being added to the retaining wall. The definition of "tightly engaged" for a combination of two interlocking posts is the condition when (1) a corner of a first post is disposed in a predetermined direction into the groove of an adjoining second post, and (2) said posts are pinned together. Predrilled holes are only in the "joining" posts and pins associated therewith are inserted into said holes and driven therethrough into the adjoining "fixed" post without drilling said fixed post for said pins. The predrilled holes are not lined up horizontally from post to post to avoid interference between pins in adjoining posts.

The diameters of the predrilled holes are dependent on structural considerations. For 4"×4" posts, the holes should be at least ¼" and for 6"×6" posts the holes should be at least ⅜". Also, for tightly engaging 4"×4" posts, 7"×¼" nails or spikes can be used and for 6"×6" posts 10"×⅜" nails or spikes can be used. Longer and stronger lag bolts may have to be considered for larger posts so that the diameters of said predrilled holes would have to be correspondingly larger. Note that nails, spikes, lag bolts, and similar engaging elements are referred to as "pins" herein. The number of predrilled holes will be dependent on the overall length of the posts where, for example, two predrilled holes would be minimum for posts up to six feet in length. Structural considerations may require an additional number as the length increases. All predrilled holes are toenailed to increase the resistance to separation of the interlocked posts.

FIG. 5B shows an example of said two tightly engaged interlocked posts of FIG. 5 wherein line post 30 is positioned to engage its corner 50 into the side groove 14 of starter post 10 at an intermediate direction such as, for example, $\neg a_1$, between respective centerlines 20 and 46. Supportive contact will be between edge 16 of a first sidewall 22 of groove 14 and side 32*a* of corner 50 and between edge 18 of second sidewall 24 of groove 14 and adjacent side 32*b* of corner 50. Said intermediate direction may also include other positions between the maximum clockwise and counter clockwise positions including a position where said centerlines coincide.

Figure 6:
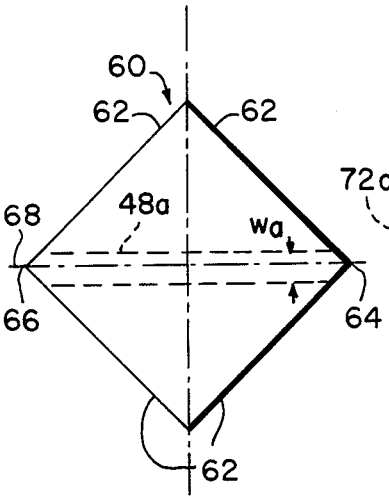
FIG. 6 is a plan view of a key post and shows the location of the predrilled holes with respect to the corners of said post.
Figure 7:
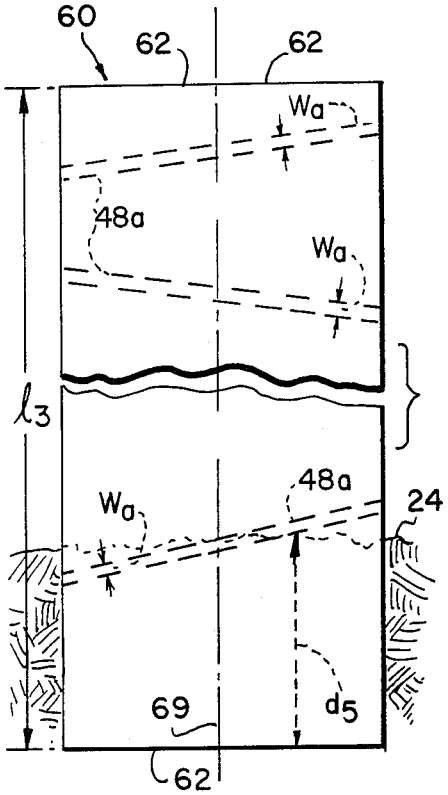
FIG. 7 is a fragmentary side view of a key post partly disposed into the ground and the predrilled holes.

FIG. 6 shows a key post 60 having a square crosssection wherein each side 62 is of a predetermined dimension and of a length $l_3$ as shown in FIG. 7. Key post 60 in FIG. 7 is positioned vertically to a depth of $d_5$ into the ground 24. A predetermined number of predrilled holes 48*a* of a diameter $w_a$ are disposed from corner 64 to corner 66 along centerline 68.

Figure 8:
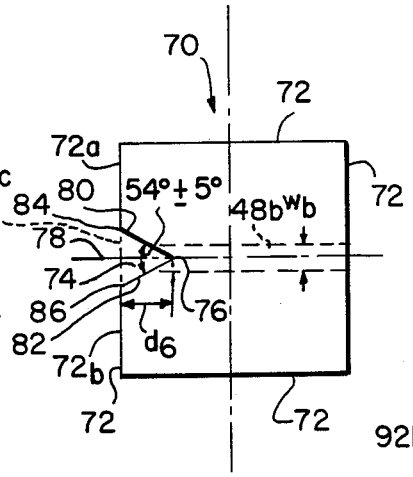
FIG. 8 is a plan view of an end post with a side groove and predrilled holes.
Figure 9:
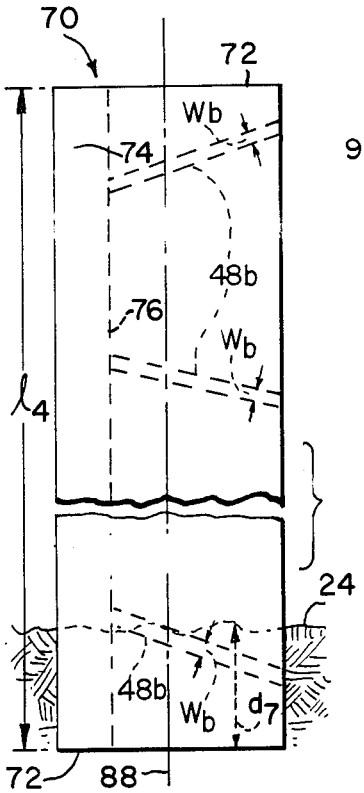
FIG. 9 is a fragmentary side view of said end post partly disposed into the ground and the predrilled holes.

In FIG. 8, end post 70 is substantially similar to starter post 10 with the exception of having a predetermined number of predrilled holes 48*b* of diameter $w_b$. Each side 72 is of a predetermined equal dimension and an overall length $l_4$ as shown in FIG. 9. A full-length equal-sided groove 74 of the aforesaid angularity is cut into a side 72 at sidewall edge 84 and at sidewall edge 86, each at a predetermined equal dimension from centerline 78 to form a first sidewall 80 and a second sidewall 82 respectively intersecting to form vertex 76 at a depth $d_6$, said edge 84 being at a predetermined dimension from edge 86. End post 70 is positioned vertically to a depth $d_7$ into the ground 24 as shown in FIG. 9. Also shown therein are the predrilled holes 48*b* of diameter $w_b$.

Figure 10:
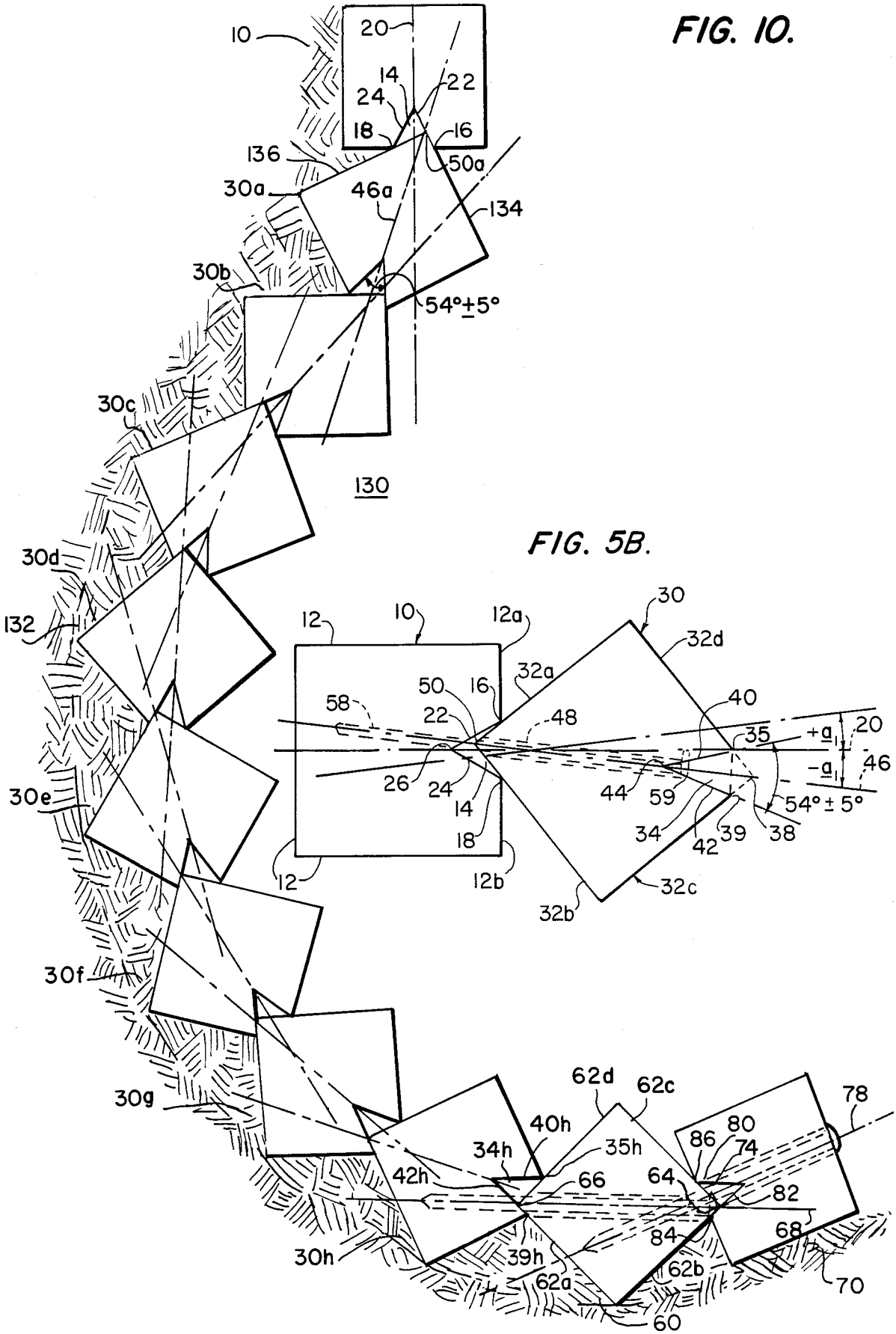
FIG. 10 is a plan view of a continuous angulated retaining wall comprised of a starter post, eight line posts, a key post, and an end post, the corners of the posts are tightly engaged in the respective grooves of the adjoining posts. It shows the corner-groove combinations with all corners disposed with maximum rotation in respective grooves.

Shown in FIG. 10 is an example of an angulated retaining wall 130 with eleven interlocking posts arranged to retain a wall of material 132 having an uneven configuration but no corners or other abrupt changes in direction. Corner 50*a* of first line post 30*a* is disposed in groove 14 of fixed starter post 10, wherein said corner is rotated to a maximum clockwise position. Side 134 and sidewall 22 are parallel and a section of side 134 overlaps by a predetermined dimension in supportive contact with sidewall 22 between corner 50*a* and sidewall edge 16 and adjacent side 136 is in supportive contact with sidewall edge 18 of post 10. A predetermined number of pins are driven through predrilled holes (not shown) of post 30*a* into the fixed post 10 to tightly engage and interlock said posts. The respective corners of the remaining posts are rotated similarly to maximum clockwise or counter clockwise positions in respective grooves. Similarly interlocked with parallel and overlapping sides and sidewalls and adjacent sides and and sidewall edges of corners and respective grooves of preceeding and successive line posts from line post 30*b* through last line post 30*h* is shown in FIG. 10. The predrilled holes and associated pins for tightly engaging said line posts are not shown in FIG. 10.

Also in FIG. 10, corner 66 of key post 60 is disposed in groove 34*h* of the last line post 30*h*, wherein said corner is rotated to a maximum counter clockwise position. Side 62*a* and sidewall 42*h* are parallel and a section of side 62*a* overlaps by a predetermined dimension in supportive contact with sidewall 42*h* between sidewall edge 39*h* and corner 66 and adjacent side 62*d* is in supportive contact with sidewall edge 35*h* of post 30*h*. Said posts are tightly engaged and interlocked as hereinabove disclosed. Additionally, corner 64 of said key post 60 is disposed in groove 74 of endpost 70, wherein said corner is rotated to a maximum clockwise position with respect to said groove. Side 62*b* and sidewall 82 are parallel and a section of side 62*b* overlaps by a predetermined dimension in supportive contact with sidewall 82 between sidewall edge 84 and corner 64 and adjacent side 62*c* is in supportive contact with sidewall edge 86 of post 70. Said posts are tightly engaged and interlocked with predrilled holes and pins as hereinabove disclosed. Intermediate positions are not shown in FIG. 10.

Figure 11:
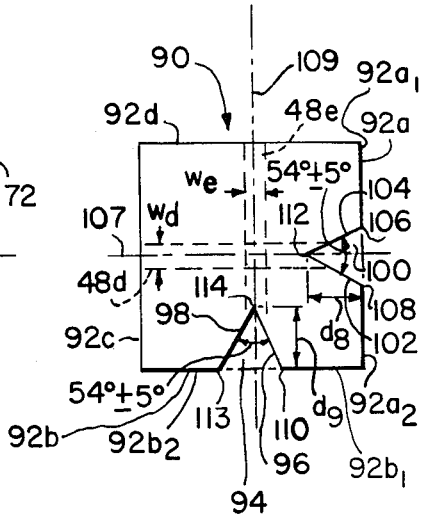
FIG. 11 is a plan view of a corner post showing the two grooves in adjacent sides and the predrilled holes.
Figure 12:
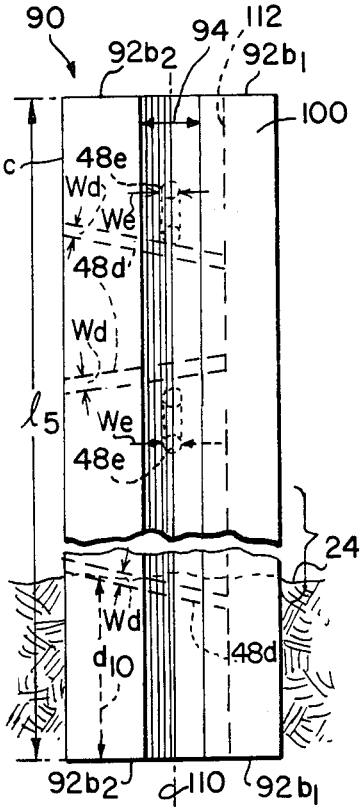
FIG. 12 is a fragmentary side view of the corner post partly disposed into the ground and the two sets of predrilled holes.

In FIG. 11, a corner post 90 has a square crosssection wherein each side 92*a*, 92*b*, 92*c*, and 92*d* is of a predetermined equal dimension and an overall length $l_5$ as shown in FIG. 12. In FIG. 11 a full-length equal-sided groove 100 is cut into side 92*a* at edges 106 and 108, each at a predetermined equal dimension from centerline 107 to form a first sidewall 102 and a second sidewall 104 respectively, said sidewalls intersecting to form a vertex 112 at a depth $d_8$ and edge 106 is at a predetermined dimension from edge 108. In addition, a full-length equal-sided groove 94 is cut into side 92*b*, adjacent to side 92*a*, at edges 110 and 113, each at a predetermined equal dimension from centerline 109 to form a first sidewall 96 and a second sidewall 98 respectively, said sidewalls intersecting to form a vertex 114 at a depth $d_9$ and edge 110 is at a predetermined dimension from edge 113. In FIG. 12, post 90 is positioned vertically to a depth $d_{10}$ into the ground 24. A predetermined number of predrilled holes 48*d* and 48*e* of diameter $w_d$ and $w_e$ respectively are disposed through post 90 from vertex 112 of groove 100 to opposite side 92*c* and from vertex 114 of groove 94 to opposite side 92*d*.

Experience indicates that the angularities of an angulated retaining wall form stable interlocking joints so that all the line posts of a plurality of line posts do not have to be disposed below ground level. However, for maximum strength, all posts must be disposed to a predetermined depth below ground. Depending on structural considerations and the type of material being retained such as, for example dirt or clay, and the height of said material, it has been observed in some instances that only one of every two or three line posts may be disposed below ground level to predetermined depths with little or no deterioration of stability.

Figure 13:
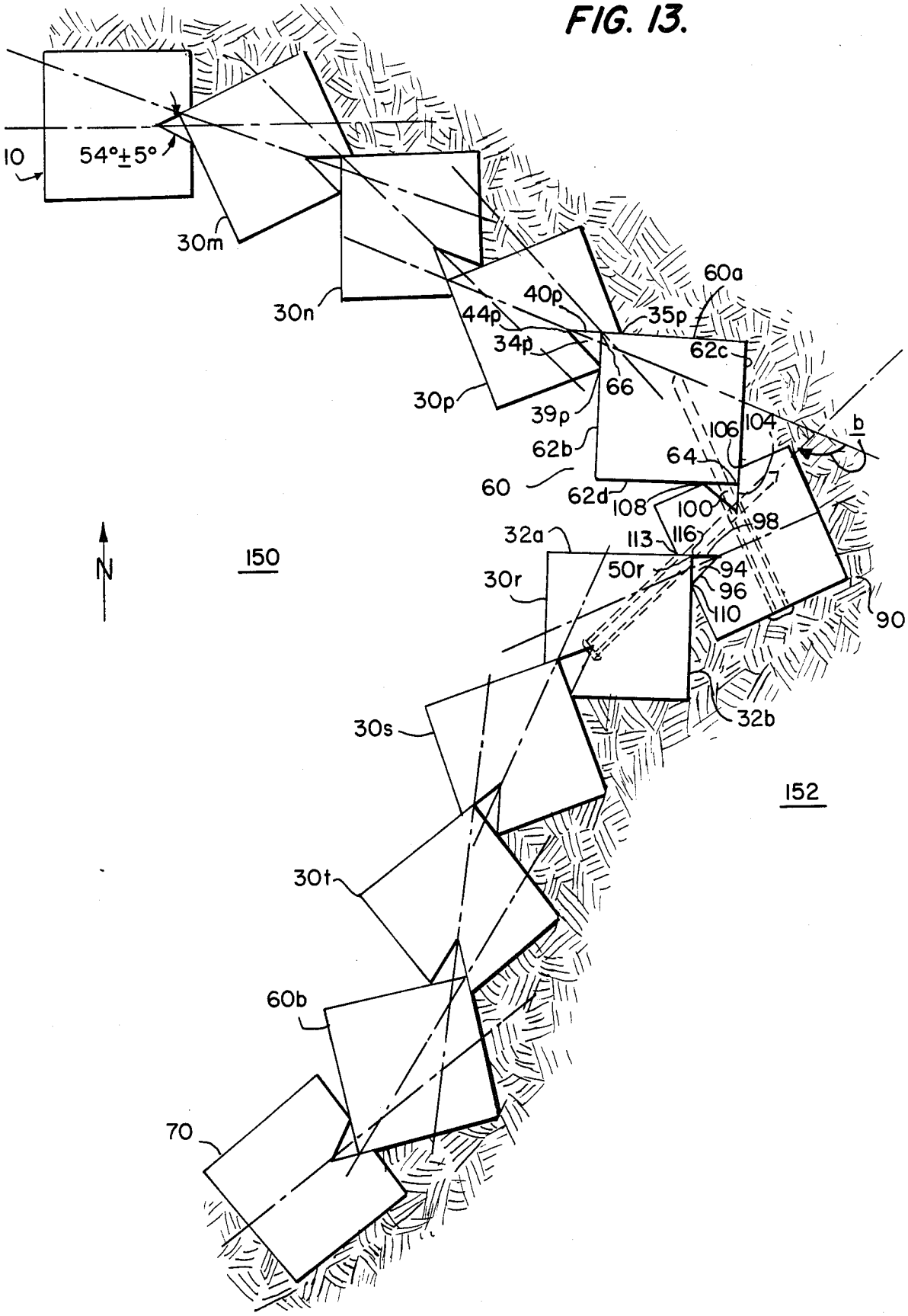
FIG. 13 is a plan view of a continuous angulated retaining wall comprised of a starter post, a first plurality of three line posts, a key post, a corner post, a second plurality of three line posts, a second key post, and an end post and shows the linking of the last line post of the first plurality of line posts with the first line post of the second plurality of line posts at an abrupt change in direction of the wall of material being retained. It also shows the corner-groove combinations with all corners disposed with maximum rotation in respective grooves.
Figure 14:
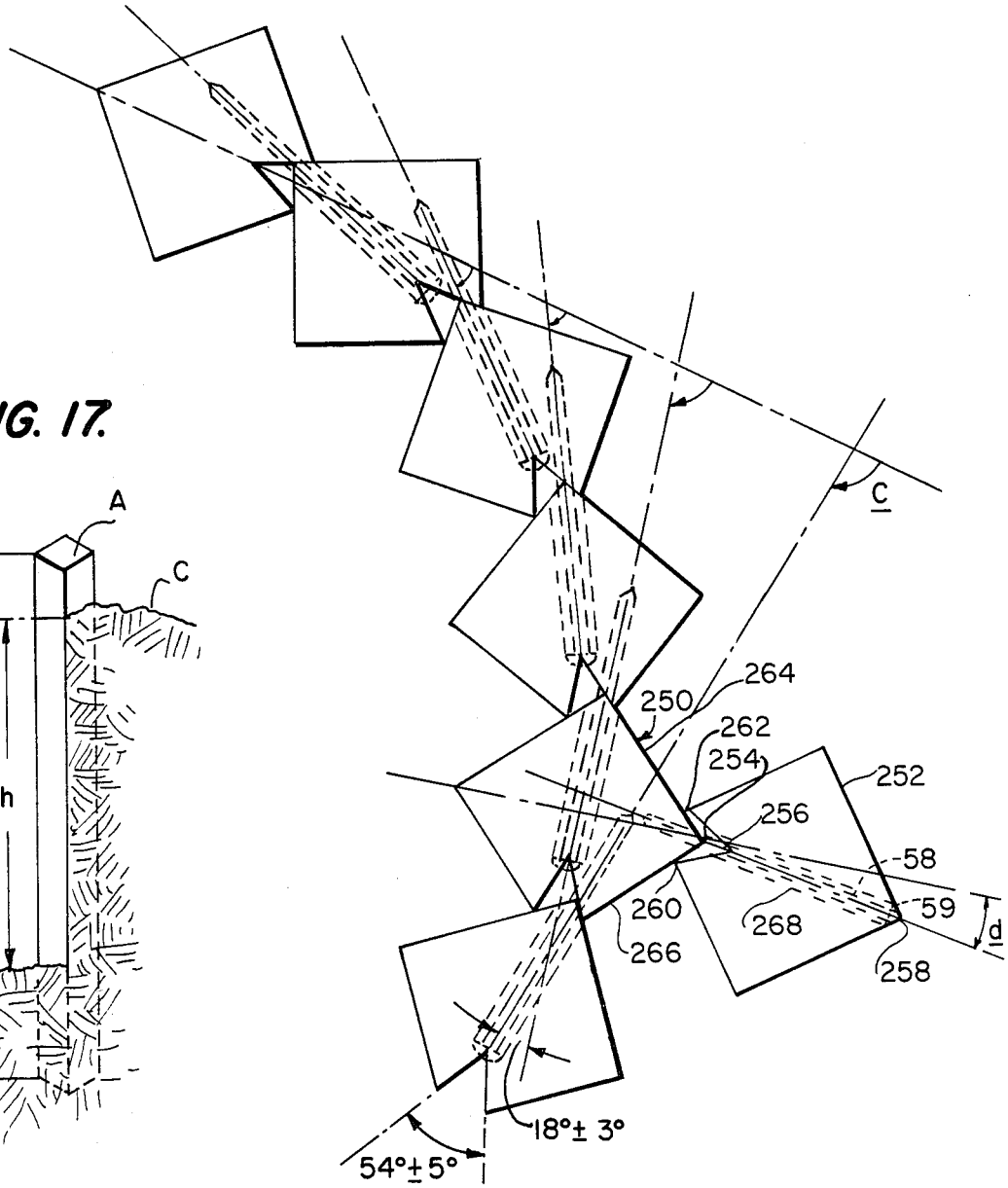
FIG. 14 is a plan view of a continuous angulated retaining wall comprising six line posts showing the corners tightly engaged in respective grooves of the preferred angularity and no abrupt changes in direction.

An example of an angulated retaining wall 150 with eleven interlocking posts arranged to retain a wall of material 152 having an uneven configuration including an abrupt change in direction is shown in FIG. 13. An abrupt change from an easternly to a southernly direction occurs from line post 30*p* to line post 30*r* wherein key post 60*a* and corner post 90 are utilized to affect the angular transition between said line posts. Corner 66 of key post 60 is disposed in groove 34*p* of line post 30*p* wherein said corner is rotated to a maximum clockwise position. Side 60*a* of corner 66 and sidewall 40*p* of groove 34*p* are parallel and a section of side 60*a* overlaps by a predetermined dimension in supportive contact with sidewall 40*p* between corner 66 and sidewall edge 35*p* and adjacent side 62*b* of corner 66 is in supportive contact with the other sidewall edge 39*p* of groove 34*p*. Said posts are tightly engaged and interlocked with predrilled holes and pins as hereinabove disclosed. Corner 64 of post 60 is disposed in groove 100 of corner post 90 wherein said corner is rotated to a maximum counter clockwise position. Side 62*c* of corner 64 and sidewall 104 of groove 100 are parallel and a section of side 62*c* overlaps by a predetermined dimension in supportive contact with sidewall 104 between corner 64 and sidewall edge 106 and adjacent side 62*d* is in supportive contact with the other sidewall edge 108 of groove 100. Also, corner 50*r* is disposed in groove 94 of corner post 90 wherein said corner is rotated to a maximum counter clockwise position. Side 32*a* and sidewall 116 are parallel and a section of side 32*a* overlaps by a predetermined dimension in supportive contact with sidewall 116 between sidewall edge 113 and corner 50*r* and adjacent side 32*b* is in supportive contact with the other sidewall edge 110 of groove 94. Said posts are tightly engaged and interlocked with predrilled holes and pins as hereinabove disclosed. Each joining post is shown in FIG. 13 at the maximum clockwise or counter clockwise direction with respect to its adjoining fixed post. Intermediate positions of the corners of said posts are not shown in FIG. 13. The 2-post combination of of key post-corner post is utilized herein as a savings in cost and space with no physical interference between line posts 30*p* and 30*r*. *Starter post 10, first* ence between line posts 30*p* and 30*r*. Starter post 10, first plurality of line posts 30*m*–30*p*, first key post 60, corner key post 60*b*, and end post 70 are all tightly engaged and interlocked as hereinabove disclosed. Generally, a sequence of line posts is utilized when gradual changes in direction occurs. In the event that only line posts are to be used for transitioning abrupt changes, and if space permits, then, as shown in FIG. 14, at least six line posts are needed to affect about a 90° change in direction as indicated by angle c. Most angularities can be achieved with sufficient line posts including a full circle. The line post combination can be expanded with additional line posts having various intermediate and maximum clockwise and counter clockwise angularities at the respective corner-groove combinations as needed.

FIG. 14 also shows, as an example, a T-joint combination that can be added to an existing wall wherein corner 254 of line post 250 is disposed at a desired direction into groove 256 of line post 252 at an intermediate angle d and wherein sides 264 and 266 of corner 254 are in supportive contact with edges 262 and 260 respectively of groove 256. Line post 252 is a first line post of a plurality of posts (not shown) of an additional retaining wall (not shown) that might be required for another application. Pins 58 are inserted into the predrilled holes 268 of post 252 and driven into adjoining post 250 to tightly engage said posts. The predrilled holes 268 should be countersunk so that heads 59 of pins 58 are not exposed at corner 258 of post 252.

Such structural considerations as the type of material to be retained and its height will determine the size of the posts to be utilized, how deep they should be disposed into the ground, the number and diameter of the predrilled holes, and the size of the pins. The configuration of the face of the wall of material to be retained will determine the angularities required for the respective corner-groove combinations of the angulated retaining wall.

Figure 15:
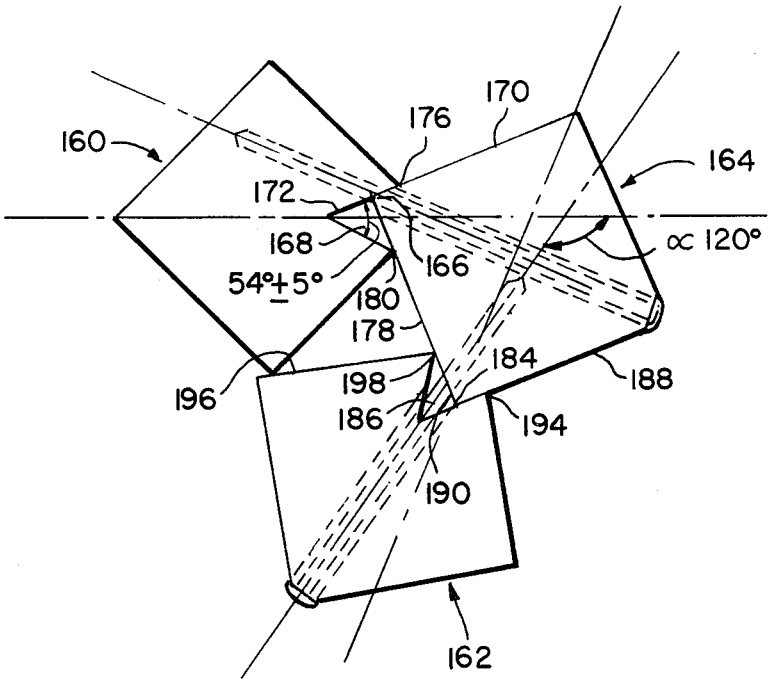
FIG. 15 is a plan view of a 3-post combination of a key post linking two line posts at an abrupt change in direction.
Figure 16:
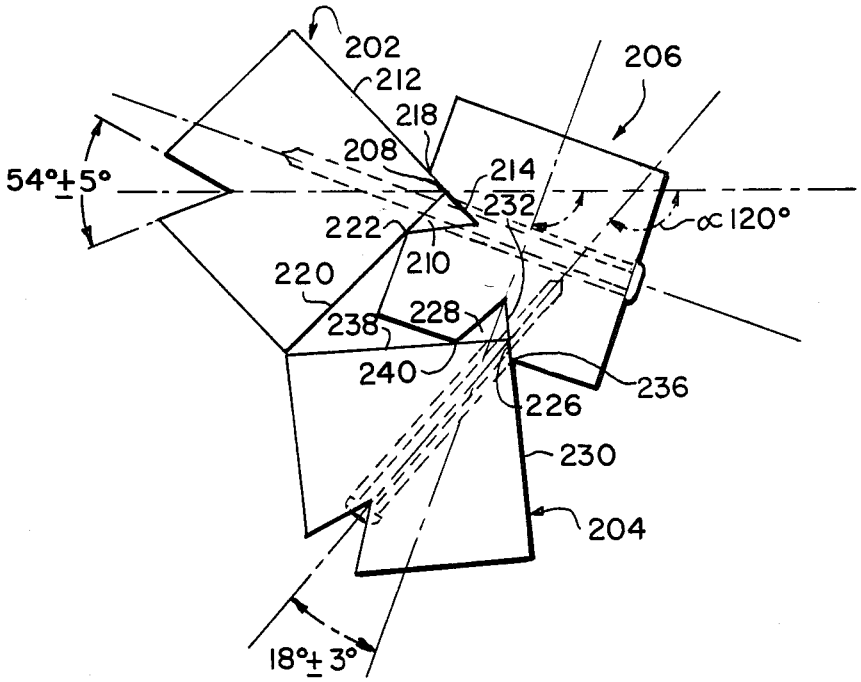
FIG. 16 is a plan view of a 3-post combination of a corner post linking two line posts at an abrupt change in direction.

Examples of alternate embodiments illustrating the combinational flexibility of the angulated retaining wall are shown in FIGS. 15 and 16 for 3-post interlocking combinations wherein the posts are at the maximum clockwise or counter clockwise directions. Said combinations are examples of those that can be utilized for abrupt changes in direction of the wall of material to be retained.

FIG. 15 shows a 3-post combination wherein the respective grooves of line post 160 and line post 162 are linked by key post 164. A first corner 166 of key post 164 is disposed in groove 168 of line post 160 wherein side 170 and sidewall 172 are parallel and side 170 overlaps by a predetermined dimension in supportive contact with sidewall 172 between sidewall edge 176 and corner 166 and adjacent side 178 of post 164 is in supportive contact with sidewall edge 180 of post 160. Said posts are tightly engaged and interlocked with predrilled holes and pins as hereinabove disclosed. A second corner 184 of key post 164 is disposed in groove 186 of line post 162 wherein side 188 and sidewall 190 are parallel and side 188 overlaps by a predetermined dimension in supportive contact with sidewall 190 between corner 184 and sidewall edge 194 and adjacent side 178 of post 164 is in supportive contact with sidewall edge 198 of post 162. Said posts are tightly engaged and interlocked with predrilled holes and pins as hereinabove disclosed. The total angularity achievable with said 3-post combination is slightly more than 120° but must be limited because of possible interference between said line posts.

FIG. 16 shows a 3post combination wherein the respective corners of line post 202 and line post 204 are linked by corner post 206. Corner 208 of line post 202 is disposed in groove 210 of corner post 206, wherein side 212 of line post 202 and sidewall 214 are parallel and side 212 overlaps by a predetermined dimension in supportive contact with sidewall 214 between corner 208 and sidewall edge 218 and adjacent side 220 of post 202 is in supportive contact edge 222 of post 206. Said posts are tightly engaged and interlocked with predrilled holes and pins as hereinabove disclosed. Corner 226 of line post 204 is disposed in groove 228 of corner post 206 wherein side 230 of line post 204 and sidewall 232 are parallel and side 230 overlaps by a predetermined dimension in supportive contact with sidewall 232 between corner 226 and sidewall edge 236 and adjacent side 238 of post 204 is in supportive contact with sidewall edge 240 of post 206. Said posts are tightly engaged and interlocked as hereinabove disclosed. The total angularity achievable with said 3-post combination is about 120° and any significant additional angularity is limited by physical interference between said posts.

Figure 17:
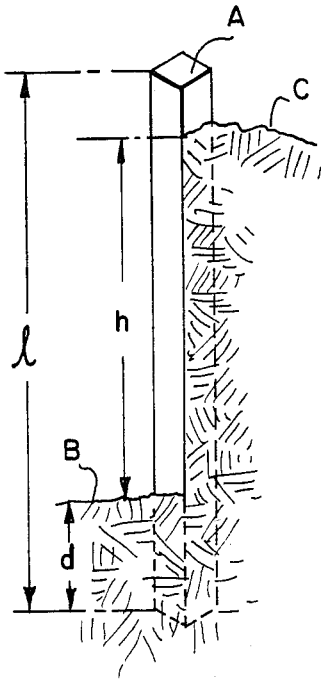
FIG. 17 is a side view of a post showing the interrelationship of the post partly disposed into the ground and retaining a wall of material of a predetermined height.

FIG. 17 is a side view of a typical post A of a plurality of posts (not shown) of an angulated retaining wall (not shown) having a length l and disposed into the ground B to a depth d, to retain a wall of material C of height h. Posts 4"×4" in crosssection retaining a 5½ foot wall of clay or dirt would be about 8 feet in length and put into the ground to a depth of about 2½ feet.

Materials other than pressure-treated, rot-resistant wood and other means for pinning or fastening may be used to obtain the tightly engaged corner-groove interlocking relationship. Possible other materials may be plastics, composites, metals, and combinations thereof. Posts may be solid, hollow, or formed shapes. Pinning means includes bolts, screws, clamps, clips, and the like associated with the specific material and shape involved, adhesives may be considered for some applications. In addition to predrilled holes, consideration could also be given to pretapped holes, slots, indents, and the like, depending on the application.

Since the preferred angularity of a groove is less than that of an inserted corner of a corner-groove combination, there is provided a 3-dimensional space between the vertex of said groove and said corner. As a result, the corner can be freely rotated therein to achieve the desired intermediate or maximum position for the desired direction for the adjoining post. At all intermediate positions, there are always two supportive contacts, namely, between the adjacent sides of said corner with the respective sidewall edges of said groove. At the maximum clockwise or counter clockwise positions there is a supportive contact between a side of said corner where it overlaps the sidewall of the groove between the said corner and the edge of said groove, as well as between the adjacent side of said corner and the other edge of said groove. Although the vertex of said groove is shown as a line intersection of the sidewalls, a flat area at the vertex will facilitate centering for the predrilled holes and subsequent countersinking of the pins.

This invention is not limited to the specific embodiments shown in the drawings and described in the specifications, but is adaptable to numerous other modifications and changes, without departing from the spirit and scope hereof, to produce an angulated retaining wall comprised of posts, characterized by corners of posts disposed in respective grooves of adjoining posts, each said post being at a predetermined direction to the respective preceeding post, said grooves having a predetermined angularity, and said corners and respective grooves tightly engaged by predetermined means.

What is claimed is:

1. An angulated retaining wall, comprising:

a. a plurality of adjoining preceeding and successive line posts, including a last line post, each having a first corner and an opposite second corner of predetermined angularity, and a full-length groove in said first corner, and wherein the second corner of an adjoining successive line post is disposed into the corner groove of the preceeding line post at a predetermined direction;

b. an adjoining key post having a first corner and an opposite second corner of predetermined angularities, and wherein the first corner is disposed into the corner groove of the preceeding last line post at a predetermined direction;

c. an adjoining corner post having a full-length first groove in a first side and a full-length second groove in an adjacent second side, and wherein the second corner of said adjoining key post is disposed into the first side groove of said corner post at a predetermined direction;

d. an adjoining second plurality of adjoining preceeding and successive line posts, including a first line post, each having a first corner and an opposite second corner of predetermined angularity, each said line post having a full-length groove in said first corner, and wherein the second corner of the first line post is disposed into the second side groove of the adjoining preceeding corner post at a predetermined direction, and the second corner of each successive line post is disposed into the corner groove of each adjoining preceeding line post at a predetermined direction;

e. means to engage each said corner into supportive contact with said respective groove, wherein each said groove has a predetermined angularity and said angularity is less than that of the respective disposing corner; and f. the combination of the first plurality of adjoining line posts, the adjoining key post, the adjoining corner post, and the adjoining second plurality of adjoining line posts forming a continuous angulated retaining wall.

2. The angulated retaining wall of claim 1 wherein said engaging means comprises a plurality of predrilled holes of predetermined dimensions in each successive post and pins of predetermined dimensions are inserted therein and driven therethrough into the respective preceeding post to tightly engage each said corner into supportive contact with the respective groove.

3. The angulated retaining wall of claim 1 wherein said predetermined angularity of each said groove is a preferred angularity wherein the groove has a first sidewall and a second sidewall intersecting in a vertex, each sidewall being equal in width and extending from said vertex to a first and second edge respectively, and each second corner having a first side and an adjacent second side, said sides intersecting in said corner, and wherein said second corner is disposed at maximum position with respect to said groove, and wherein the first side is parallel to the first sidewall at said maximum position and overlaps in supportive contact with said first sidewall between said second corner and said first edge, said second corner and said first edge being separated by a predetermined dimension, and the adjacent side is in supportive contact with said second edge, the first edge and second edge being separated by a predetermined dimension.

4. The angulated retaining wall of claim 1 wherein said predetermined angularity of each said groove is a preferred angularity wherein the groove has a first sidewall and a second sidewall intersecting in a vertex, each sidewall being equal in width and extending from said vertex to a first and second edge respectively, and each second corner having a first side and an adjacent second side, said sides intersecting in said corner, and wherein said second corner is disposed at an intermediate position with respect to said groove, said first side and said adjacent second side of said second corner are in supportive contact with said first edge and said second edge respectively of said groove in said intermediate position.

5. The angulated retaining wall of claim 1 wherein the predetermined angularity of said groove is 54°±5° and the predetermined angularity of the corners is substantially 90°.

6. An angulated retaining wall, comprising:

a. a starter post having a side and a full-length groove in said side;

b. an adjoining plurality of adjoining preceeding and successive line posts, including a first line post and a last line post, each having a first corner and an opposite second corner of predetermined angularity, and a full-length groove in said first corner, and wherein the second corner of the first line post is disposed into the side groove of the preceeding starter post at a predetermined direction, and wherein the second corner of each adjoining successive line post is disposed into the corner groove of each preceeding line post at a predetermined direction;

c. an adjoining key post having a first corner and an opposite second corner of predetermined angularities, and wherein the first corner is disposed into the corner groove of the preceeding last line post at a predetermined direction;

d. an adjoining end post having a side and a full-length groove in said side and wherein the second corner of the preceeding key post is disposed in said side groove at a predetermined direction;

e. means to engage each said corner into supportive contact with the respective groove wherein each said groove has a predetermined angularity and said angularity is less than that of the respective disposing corner;

f. the combination of the starter post, the adjoining plurality of line posts, the adjoining key post, and the adjoining end post, forming a continuous angulated retaining wall.

7. The angulated retaining wall of claim 6 wherein said engaging means comprises a plurality of predrilled holes of predetermined dimensions in each successive post and pins of predetermined dimensions inserted into said holes and subsequently driven therethrough into the respective preceeding post to tightly engage each said corner into supportive contact with the respective groove.

8. The angulated retaining wall of claim 6 wherein said predetermined angularity of each said groove is a preferred angularity wherein the groove has a first sidewall and a second sidewall intersecting in a vertex, each sidewall being equal in width and extending from said vertex to a first and second edge respectively, and each second corner having a first side and an adjacent second side, said sides intersecting in said corner, and wherein said second corner is disposed at maximum position with respect to said groove, and wherein the first side is parallel to said first sidewall at said maximum position and overlaps in supportive contact with said first sidewall between said second corner and said first edge, said second corner and said first edge being separated by a predetermined dimension, and the adjacent side is in supportive contact with said second edge, the first edge and second edge being separated by a predetermined dimension.

9. The angulated retaining wall of claim 6 wherein said predetermined angularity of each said groove is a preferred angularity wherein the groove has a first sidewall and a second sidewall intersecting in a vertex, each sidewall being equal in width and extending from said vertex to a first and second edge respectively, and each second corner having a first side and an adjacent second side, said sides intersecting in said corner, and wherein said corner is disposed at an intermediate position with respect to said groove, said first side and said adjacent second side of said corner are in supportive contact with said first edge and said second edge respectively of said groove in said intermediate position.

10. The angulated retaining wall of claim 6 wherein said predetermined angularity of said groove is 54°±5° and the predetermined angularity of the corners is substantially 90°.

11. An angulated retaining wall, comprising:

a. a plurality of adjoining preceeding and successive posts each having a first corner and an opposite second corner of predetermined angularity;

b. a full-length groove of preferred angularity in each said first corner, where said groove has a first sidewall and a second sidewall intersecting in a vertex, each sidewall being equal in width and extending from said vertex to a first and second edge respectively, and each said second corner having a first side and an adjacent second side, said sides intersecting in said corner;

c. said second corner of each successive post is disposed at a maximum position into the groove of the preceeding adjoining post wherein the first side is parallel to the first sidewall at said maximum position and overlaps in supportive contact with said first sidewall between said second corner and said first edge, said second corner and said first edge being separated by a predetermined dimension, and said adjacent side is in supportive contact with said second edge, the first edge and the second edge being separated by a predetermined dimension;

d. a plurality of predrilled holes of predetermined dimensions in each successive post and pins of predetermined dimensions inserted into said holes and driven therethrough in the respective preceeding post to tightly engage each said second corner with the respective corner groove; and e. the combination of the plurality of adjoining posts, the disposition of the second corner of a successive post into supportive contact with a groove of a respective preceeding post, and the plurality of predrilled holes and pins for tightly engaging said corner and groove, each successive post at a predetermined direction with respect to the respective preceeding post, forming a continuous angulated retaining wall.

12. The angulated retaining wall of claim 11 wherein each second corner of each successive post is disposed at an intermediate position into the groove of the preceeding adjoining post wherein the first side and the adjacent side of said corner are in supportive contact with the first and second edges of said groove respectively in said intermediate position.

13. The angulated retaining wall of claim 11 wherein the preferred angularity of said groove is 54°±5° and the predetermined angularity of the corners is substantially 90°.

14. An angulated retaining wall, comprising:

a plurality of adjoining preceeding and successive posts wherein each successive post is engaged by engaging means in supportive contact at a predetermined direction to the adjoining preceeding post, each post having a first corner with a full-length groove of a first angularity and an opposite second corner of a second angularity; said groove has a first sidewall and a second sidewall intersecting in a vertex that extend equally from the vertex to a first edge and to a second edge respectively; said second corner has a first side and an adjacent side, the sides intersecting in said corner and, when the second corner of a successive post is disposed into the groove of the adjoining preceeding post at a predetermined maximum direction, the first side is parallel to the first sidewall and is in supportive contact with the first sidewall and the adjacent side is in supportive contact with the second edge; when the second corner of a successive post is disposed in the groove of an adjoining preceeding post at a predetermined intermediate direction, the first side and the adjacent side are in supportive contact with the first edge and the second edge respectively; wherein said engaging means comprise pins of predetermined dimensions inserted into holes predrilled into each successive post and driven therethrough into the adjoining preceeding post to tightly engage each said second corner with the respective corner groove; and wherein the preferred first angularity is 54°±5° and the preferred second angularity is substantially 90°.

* * * * *